United States Patent [19]

Johanson

[11] Patent Number: 4,675,001

[45] Date of Patent: Jun. 23, 1987

[54] CENTRIFUGE ROTOR

[75] Inventor: William G. Johanson, Newark, Del.

[73] Assignee: E. I. Du Pont de Nemours and Company, Wilmington, Del.

[21] Appl. No.: 758,123

[22] Filed: Jul. 23, 1985

[51] Int. Cl.[4] ..... B04B 7/00

[52] U.S. Cl. ..... 494/85; 494/16

[58] Field of Search ..... 494/85, 81, 16; 422/72; 210/781, 782; 74/572; 416/230

[56] References Cited

U.S. PATENT DOCUMENTS

| | | | |
|---|---|---|---|
| 3,950,115 | 4/1976 | Euler | 416/226 |
| 4,038,885 | 8/1977 | Jonda | 74/581 |
| 4,293,276 | 10/1981 | Brogdon et al. | 416/134 |
| 4,451,250 | 5/1984 | Romanauskas | 494/16 X |
| 4,458,400 | 7/1984 | Friedericy et al. | 29/159 |
| 4,483,214 | 11/1984 | Mayer | 74/572 |
| 4,502,349 | 3/1985 | Abiven et al. | 74/572 |

*Primary Examiner*—Timothy F. Simone

[57] ABSTRACT

A centrifuge rotor having a base plate with a plurality of support posts mounted thereon. Each support post receives and supports the radially inner end of a sample container support element formed of a wound composite material. The outer end-turn of the support element receives and supports a sample container. The side walls of the support element are arranged to lie generally radially of the central vertical axis of the rotor.

18 Claims, 3 Drawing Figures

CENTRIFUGE ROTOR

BACKGROUND OF THE INVENTION

1. Field of the Invention

This invention relates to a centrifuge rotor fabricated using a composite structural material.

Presently high speed, and particularly ultra-high speed, centrifuge rotors are manufactured utilizing homogeneous materials, such as titanium and aluminum. However it has been recognized that an increased strength-to-weight ratio is obtainable if a rotor is fabricated from composite structural material.

U.S. patent application Ser. No. 684,937, filed Dec. 21, 1984, discloses and claims a rotor element wound from a composite material and a centrifuge fabricated therefrom. As there disclosed, a rigidized structural member is formed by winding a high strength fiber material into a predetermined configuration in which the member is lesser in height at its central region than at its ends. A plurality of such members may be stacked one atop the other to form a multi-place centrifuge rotor. Each wound member is defined by generally parallel extending side portions connecting through curved end-turn portions. A sample container is appropriately secured within each end-turn portion. The fibers in each of the generally parallel extending sides are arranged so as to lie in the direction of the maximum stress imposed on the member. That is, the fibers are arranged so as to orient their maximum strength along the direction of maximum stress.

The particular configuration of each member as described in the referenced application is mandated by the necessity of having each of the fibers which form the wound member pass as close as possible to the geometric center of rotation of the rotor while at the same time permitting a plurality of such members to be stacked to form a multi-place rotor.

It is believed advantageous to avoid the requirement of passing each of the fibers through the geometric center yet at the same time provide a structure in which the highest tensile strength of the fiber is oriented along generally radial directions from the center of the rotor.

SUMMARY OF THE INVENTION

In accordance with the present invention a centrifuge rotor using high strength composite fiber material in which the fibers extend substantially radially of the rotor yet are arranged in a manner which avoids the necessity of each fiber passing through the geometric center of the rotor.

The rotor in accordance with the present invention comprises a first plate mounted for rotation about a central axis. As array of upstanding posts is secured to the plate in a predetermined configuration about the axis. Each post receives a sample container support element. Each support element is a composite structure formed of a high tensile strength fiber composite material wound to define opposed side portions connected through curved end-turn portions. One of the end-turn portions of each sample container support element is configured to be received about one of the posts mounted on the rotor base. The other of the end-turn portions of the support element is configured to receive and to support a sample container.

BRIEF DESCRIPTION OF THE DRAWINGS

The invention will be more fully understood from the following detailed description thereof taken in connection with the accompanying drawings which form part of this application and in which.

DETAILED DESCRIPTION OF THE INVENTION

Figure 1:
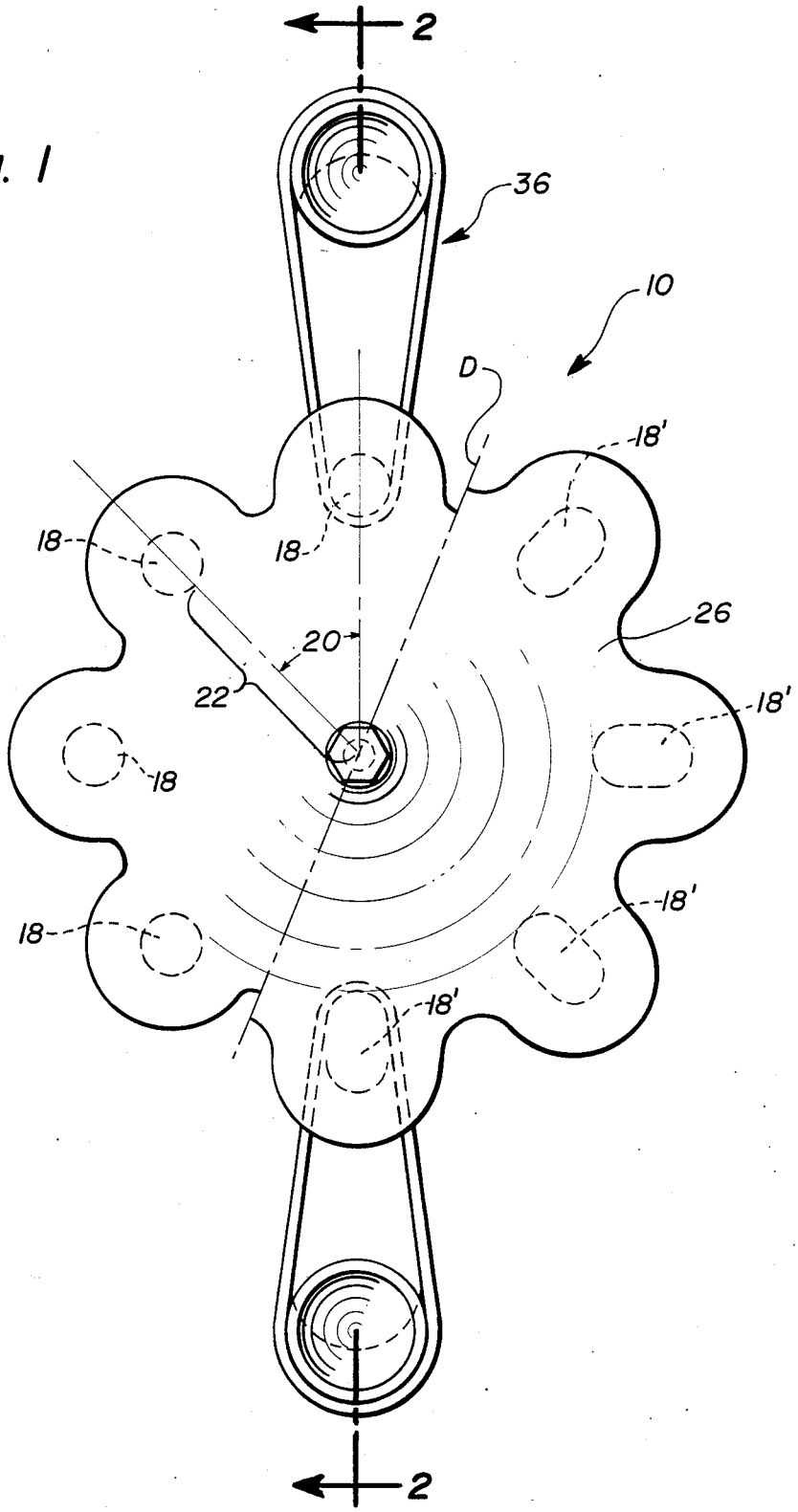
FIG. 1 is a plan view of a centrifuge rotor in accordance with the present invention.

Throughout the following detailed description similar reference numerals refer to similar elements in all figures of the drawings.

In the figures generally indicated by reference character 10 is a centrifuge rotor fabricated in accordance with the present invention. The rotor 10 includes a first, or base, plate 12 machined or otherwise formed from a suitable structural material such as aluminum or titanium.

The rotor base plate 12 is tapered or otherwise configured to achieve a constant radial stress profile. The base plate 12 is connected by a suitable drive arrangement 14 to a source of motive energy 16 whereby the rotor 10 may rotate about a central axis of rotation VCL.

An array of upright posts 18 or 18' is disposed on the base plate 12 in a predetermined pattern with respect to the central axis of rotation VCL. Preferably, but not necessarily, each post 18 or 18' is arranged in an annular array with each post 18 in the array being offset from adjacent posts by predetermined angular spacings 20. It is also preferred that each post 18 is also an equal radial distance 22 from the vertical center line VCL. Of course any other arrangement of the individual posts 18 or 18' with respect to each other and to the center line VCL may be utilized and remain within the contemplation of the present invention. To facilitate the mounting of the post 18 or 18' into position on the base plate 12, individual recesses 24 may be provided in the base plate 12.

The post 18 may exhibit any predetermined cross-sectional configuration when viewed in the plan view of FIG. 1. In the most preferred case the posts 18 exhibit a circular cross-section. That is, the posts 18 are circular when viewed in a plane perpendicular to the axis of rotation VCL. However, a preferred alternate design would be a post 18' having a substantially oblong configuration so that the shear area of each post at its point of attachment to the base plate 12 is increased. Having a post 18' with an oblong cross-section provides circumferential rigidity to the rotor 10, i.e., it prevents any member mounted to the post 18' from rotating about the post 18'. Both alternatives are illustrated in FIG. 1. Those posts 18 to the left of the dividing line D being circular in cross-section while those posts 18' to the right of the line D being oblong. It is understood, of course, that in any particular configuration of rotor it is preferred that all posts 18 or 18' exhibit the same cross-section configuration and that the illustration of figures in the rotor having both circular and oblong posts is only for purposes of convenience of illustration.

The rotor 10 may be provided with a cover 26 if desired. The cover 26 is configured and formed into a tapered configuration for stress equality in a manner similar to that discussed with the base plate 12. A central aperture 28 extends through the cover 26. A connecting pin 30 passes through the aperture 28 and is threadedly secured into the central portion of the base plate 12. An array of recesses 32 corresponding in both radial and circumferential position to the location of the recesses 24 in the base plate 12 is provided in the cover 26 in order to capture the upper ends of the posts 18 or 18'. Of course, the profile of the recesses 32 corresponds to the shape of the posts 18 or 18' utilized in any particular embodiment of the rotor 10.

The rotor 10 further includes an array of sample container support elements 36. Each of the support elements 36 is formed from a wound fiber reinforced composite material. The support element 36 is defined by side walls 38A and 38B connected through curved end-turn portions 40A and 40B. The support elements 36 may be fabricated by winding a high strength composite material about a mandrel. Suitable for such use is a high strength aramid fiber sold by E. I. du Pont de Nemours and Company under the trademark "Kevlar". The structure resulting therefrom may be rigidized by the provision of any suitable curable or hardenable matrix material. The member 36 is wrapped such that the curvature of the radially inner end-turn portion 40A conforms to the shape of the post 18 or 18' with which it will be associated. The radially outer end-turn portion 40B is provided with a different radius of curvature and is sized to receive a sample container 44 therewithin. The sample container 44 is fabricated of any suitable material, such as aluminum or titanium, and is secured in any suitable manner to the interior surface of the radially outer end-turn portion 40B.

The sample container support elements 36 are wound such that the side portions 38A and 38B coincide with radii of the rotor 10. With this configuration the fibers of the support element 36 are loaded in tension thereby substantially minimizing bending or hoop stresses.

Figure 2:
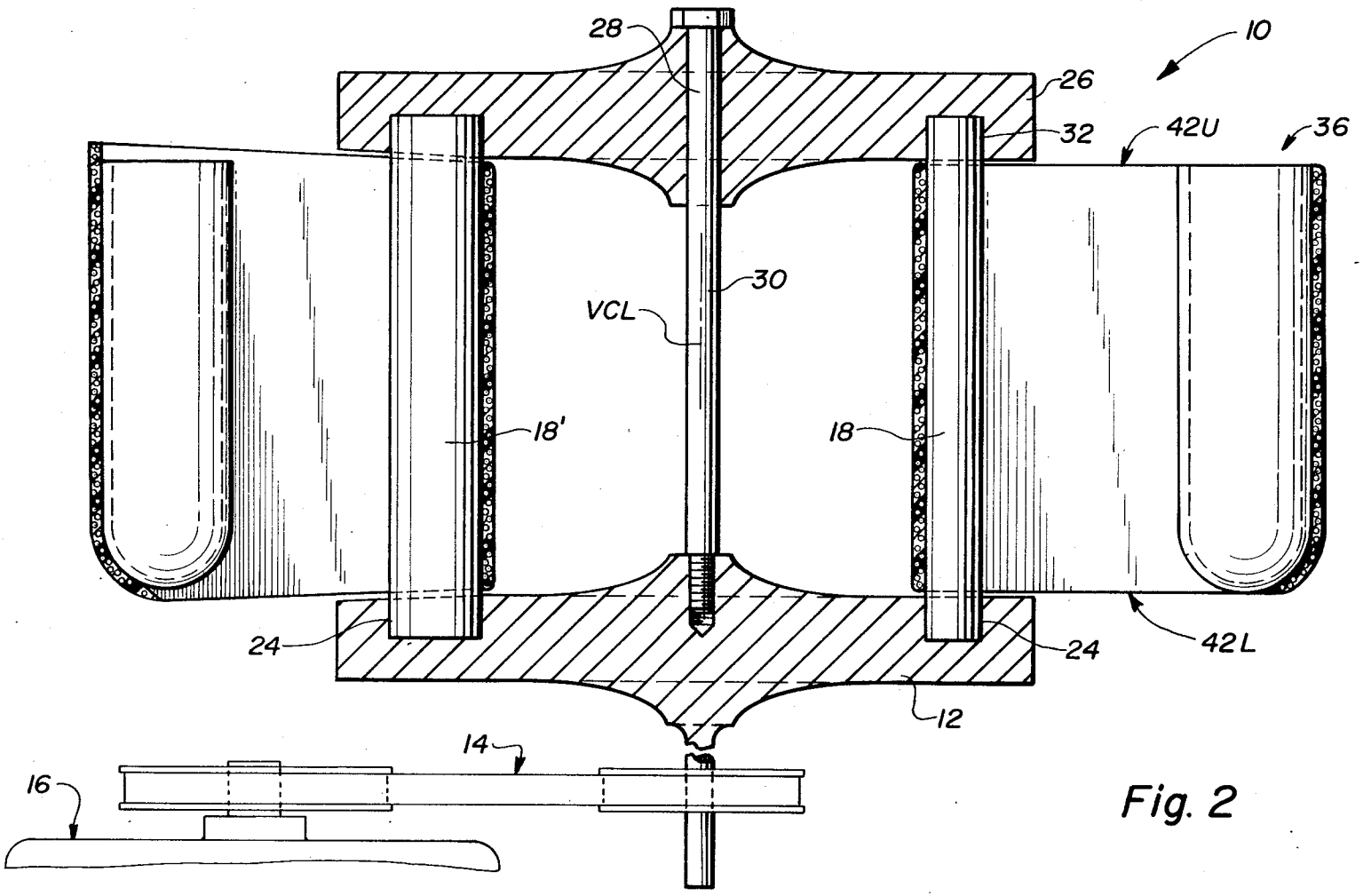
FIG. 2 is a sectional view taken along section lines 2—2 of FIG. 1.
Figure 3:
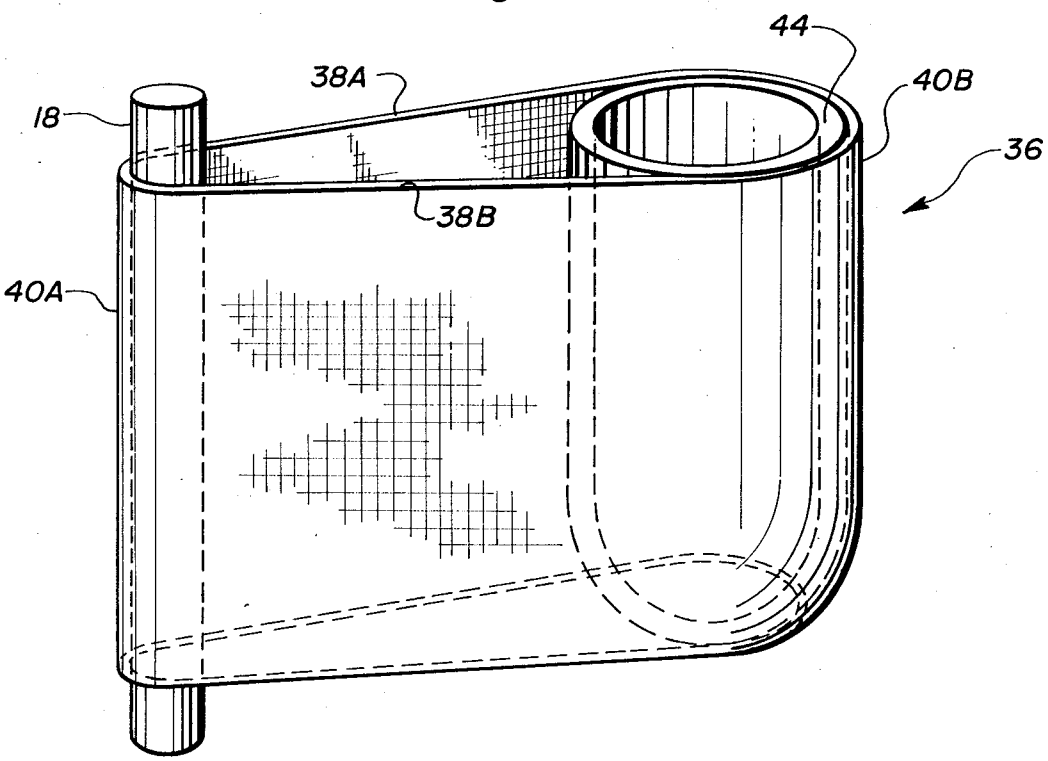
FIG. 3 is an isolated perspective view of an individual sample container support element and an associated post.

As seen from FIG. 2 the container support element 36 may have upper and lower edges 42U and 42L which in one embodiment extend substantially perpendicularly to the axis of rotation of the VCL. This arrangement is illustrated on the right half of FIG. 2. In an alternate embodiment the edges 42U and 42L may be inclined slightly with respect to the axis of rotation VCL. In the latter instance the base plate 12 and the cover 26 are tapered in a conforming manner to receive the support elements therebetween. This is shown in the left half of FIG. 2. It should be understood that either form of support element may be used with either of the posts 18 or 18'.

Once the support elements 36 are fabricated they are secured with the radially inner end-turn portions 40A surrounding their associated posts 18 or 18'. The elements 36 are thereafter secured by the posts 18 or 18' to prevent rotation of the elements 36 about the posts 18 or 18'. If the posts 18' were used, their oblong cross-section would prevent rotation on the basis of the interacting geometries. If circular posts 18 are used it would be possible to provide grooves in the base plate 12 and the cover 26 to receive the upper and lower edges of the members 36 and thereby lock the member 36 into a nonrotatable position. Any other suitable expedient to provide circumferential rigidity may be used. The posts 18 or 18' are then mounted to the base plate 12. The cover 26, if provided, is placed over the upper ends of the posts 18 or 18'. The connecting pin 30 thereafter secures the cover 26 to the base plate 12.

Those skilled in the art having benefit of the teachings of the present invention as hereinabove set forth may effect numerous modifications thereto. These modifications are to be construed to lie within the contemplation of the present invention as defined in the appended claims.

What is claimed is:

1. A centrifuge rotor comprising:

a first plate;

a post having a first end and a second, other, end and having a predetermined exterior configuration, one end of the post being supported from the first plate;

a sample container support element mounted to the post, the support element being formed of a composite material and having generally radially extending side walls connected to each other through a radially inner and a radially outer curved end-turn portion, the radially inner end-turn portion being configured to correspond to the exterior configuration of the post; and a sample container secured on the interior of the radially outer end-turn portion of the support element.

2. The rotor of claim 1 further comprising a second plate secured to the first plate and arranged to support the other end of the post.

3. The rotor of claim 1 wherein the support post is circular in cross-sectional configuration.

4. The rotor of claim 2 wherein the support post is circular in cross-sectional configuration.

5. The rotor of claim 1 wherein the support post is oblong in cross-sectional configuration.

6. The rotor of claim 2 wherein the support post is oblong in cross-sectional configuration.

7. The rotor of claim 1 wherein the upper and lower edges of the sample container support element each lie substantially perpendicular to the axis of rotation.

8. The rotor of claim 2 wherein the upper and lower edges of the sample container support element each lie substantially perpendicular to the axis of rotation.

9. The rotor of claim 3 wherein the upper and lower edges of the sample container support element each lie substantially perpendicular to the axis of rotation.

10. The rotor of claim 4 wherein the upper and lower edges of the sample container support element each lie substantially perpendicular to the axis of rotation.

11. The rotor of claim 5 wherein the upper and lower edges of the sample container support element each lie substantially perpendicular to the axis of rotation.

12. The rotor of claim 6 wherein the upper and lower edges of the sample container support element each lie substantially perpendicular to the axis of rotation.

13. The rotor of claim 1 wherein the upper and lower edges of the sample container support element are each inclined at a predetermined angle with respect to the axis of rotation.

14. The rotor of claim 2 wherein the upper and lower edges of the sample container suppport element are each inclined at a predetermined angle with respect to the axis of rotation.

15. The rotor of claim 3 wherein the upper and lower edges of the sample container support element are each inclined at a predetermined angle with respect to the axis of rotation.

16. The rotor of claim 4 wherein the upper and lower edges of the sample container support element are each inclined at a predetermined angle with respect to the axis of rotation.

17. The rotor of claim 5 wherein the upper and lower edges of the sample container support element are each inclined at a predetermined angle with respect to the axis of rotation.

18. The rotor of claim 6 wherein the upper and lower edges of the sample container support element are each inclined at a predetermined angle with respect to the axis of rotation.

* * * * *